United States Patent [19]

Abel

[11] Patent Number: 4,523,184

[45] Date of Patent: Jun. 11, 1985

[54] SUPERVISED WIRELESS SECURITY SYSTEM

[75] Inventor: William E. Abel, Portland, Oreg.

[73] Assignee: Sentrol, Inc., Portland, Oreg.

[21] Appl. No.: 429,116

[22] Filed: Sep. 30, 1982

[51] Int. Cl.[3] ..... G08B 1/08

[52] U.S. Cl. ..... 340/539; 340/531; 340/346; 455/56

[58] Field of Search ..... 340/539, 500, 506, 536, 340/531, 533, 534, 825.2, 825.21, 825.44, 825.49, 825.47, 825.45, 345, 346; 455/9, 38, 51, 53, 56, 65

[56] References Cited

U.S. PATENT DOCUMENTS

| | | | |
|---|---|---|---|
| 3,713,125 | 1/1973 | Miller | 340/539 |
| 3,792,455 | 2/1974 | Phillips | 340/539 |
| 3,848,231 | 11/1974 | Wootton | 340/539 |
| 3,902,478 | 9/1975 | Konopasek et al. | 340/539 |
| 3,928,849 | 12/1975 | Schwarz | 314/514 |
| 4,020,477 | 4/1977 | Holland | 455/53 |
| 4,027,276 | 5/1977 | Shaushnessy | 340/539 |
| 4,056,815 | 11/1977 | Anderson | 340/539 |
| 4,095,211 | 6/1978 | Shaughnessy | 340/539 |
| 4,101,872 | 7/1978 | Pappas | 340/539 |
| 4,109,239 | 8/1978 | Davis | 340/539 |
| 4,163,968 | 8/1979 | Davis | 340/539 |
| 4,191,948 | 3/1980 | Stockdale | 340/539 |
| 4,232,308 | 11/1980 | Lee et al. | 340/539 |

OTHER PUBLICATIONS

"Proceedings 1977 Carnaham Conference on Crime Countermeasures", Apr. 6–8, 1977.

*Primary Examiner*—Donnie L. Crosland
*Attorney, Agent, or Firm*—Chernoff, Vilhauer, McClung, Birdwell & Stenzel

[57] ABSTRACT

Apparatus and method for communication by use of a single FM radio frequency, from a plurality of transmitters to a central receiver in a security alarm system or similar system. A transmitter's radio frequency signal is modulated in wide frequency swings to transmit digitally encoded address, subaddress, and sensor status information in a very brief format. A transmission is provided periodically from each transmitter, but a very low duty cycle is used to avoid interference among the transmitters. A transmitter frequency sweep provides the receiver an opportunity to lock onto a transmission before data is transmitted. Thereafter the receiver automatically tracks the rapidly varying frequency of the transmitted signal. Address and subaddress data identify each transmission and a maintenance warning ir provided by the receiver-decoder unit to identify any transmitter which fails to report within a predetermined time. Each significant sensor status change initiates a transmission from the related transmitter. Low duty cycle and low transmitter power requirements provide long transmitter battery life.

5 Claims, 9 Drawing Figures

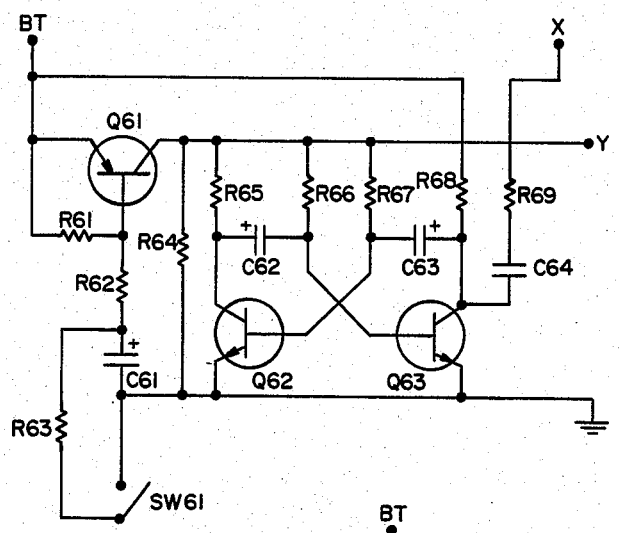
FIG. 3a
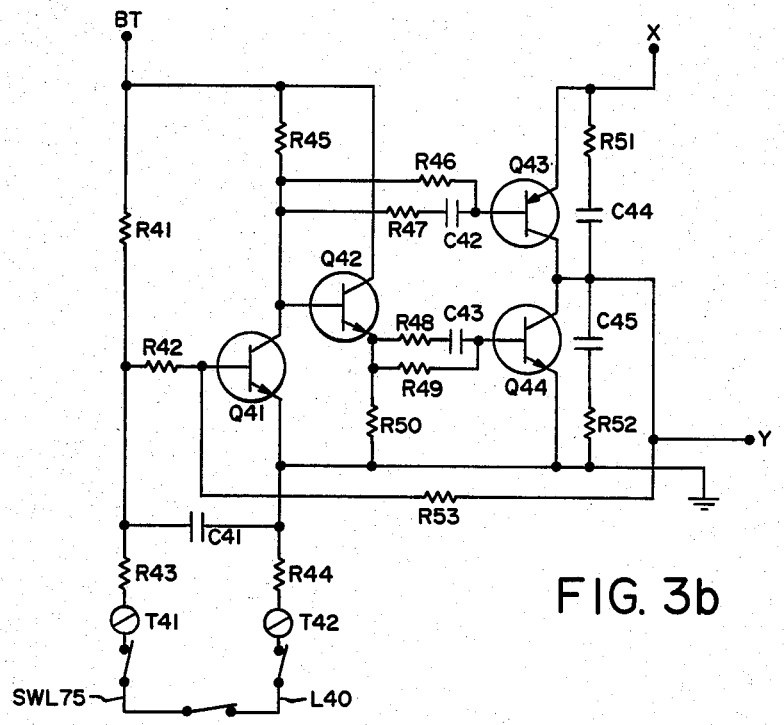
FIG. 3b
FIG. 4
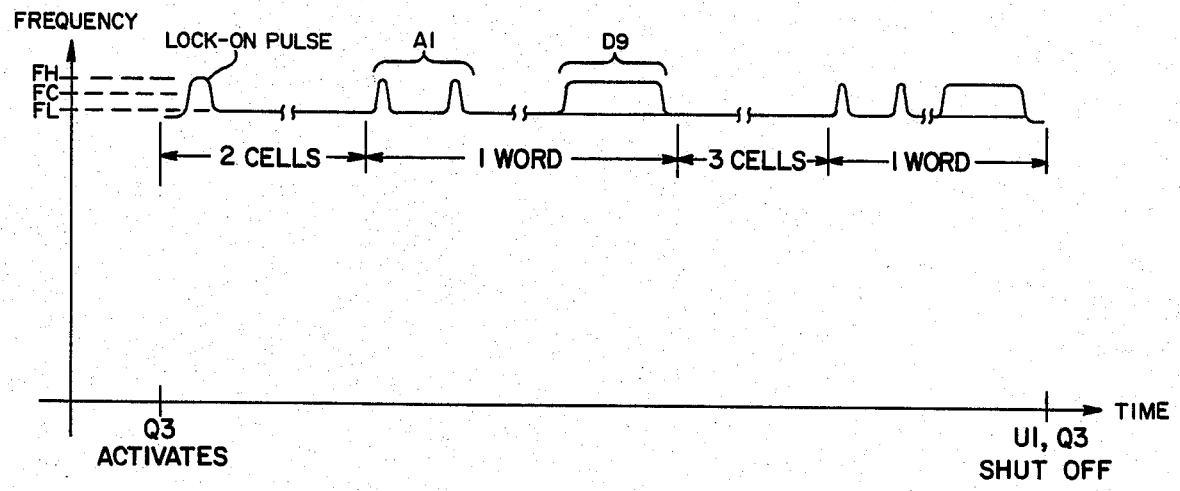

SUPERVISED WIRELESS SECURITY SYSTEM

BACKGROUND OF THE INVENTION

The present invention relates to a security alarm system incorporating a radio communication link between remote sensors and a central security monitoring device.

It has long been considered desirable in an alarm system to use a radio communication link between the remote sensors, such as door switches, window switches, manually-operable personal emergency signal switches, and the like, and a central security monitoring and alarm-signaling device. The potential advantages of such a system include avoiding the expense of installing wiring between remote switches and the central monitoring device, invulnerability of a radio-linked system to cutting of linking wiring, and the possibility of using a portable central security monitoring device.

The disadvantages of previously available wireless systems, however, have made such systems extremely costly, undependable, or both. While it is possible to reduce the cost of such systems by using a single radio transmission frequency for all of the sensor-transmitter units in a system, use of a single radio frequency present problems of mutual interference between the several transmitters of a system. This problem is potentially increased where there are several similar systems operating in proximity with one another on the same frequency, as is possible within a large office building.

Another problem in previously known wireless alarm systems has been the absence of a transmitted signal so long as there is no unauthorized passage through an alarm-equipped door or window. The radio transmitters associated with the door switches or other sensors in such a system are ordinarily battery-powered, to leave the system operable in the event of commercial power failure, and transmission is minimized to extend battery life. The lack of a continuous positive indication that each particular transmitter is operable has resulted in a general lack of faith in such radio-linked alarm systems in the past. Although it would be possible to continuously transmit signals indicating a normal or safe condition, this would rapidly drain the battery supply power of a remote transmitter in such a system. Additionally, FCC regulations limit the amount of time during which such systems are permitted to transmit, making continuous transmission illegal. One solution to this problem, therefore, has been the use of periodic transmissions of limited duration from each of the transmitters in an alarm system. Mutual radio interference is a problem inherent in such a method of operation of an alarm system, however, when a single transmission frequency is used for all of the transmitter units of the system. Avoiding such interference by using a multiplicity of transmission frequencies increases the cost of a receiver portion of the system. Use of a schedule system to avoid simultaneous transmissions by the various transmitters of a system also adds to the cost of the system.

A separate, but related disadvantage of previously known radio-linked alarm systems has been the necessity to compromise between the desired small transmitter size which would permit convenient inconspicuous mounting of transmitter units in, for example, a window frame or doorway frame, and the desirability of extending the length of time during which the transmitters will remain operable without battery replacement.

Yet another problem which must be addressed in development of a radio-linked alarm system is that it is desirable to know which of several sensors has detected an intrusion and originated an alarm signal transmission. This particular problem has been addressed previously in several ways, including pulse-count identification codes, transmitter identification by transmitted tone modulation, and by digital identification codes transmitted either by transmission pulse techniques or frequency shift keying. As previously employed, however, none of these techniques avoids the problem of mutual radio frequency interference among several transmitters all operating on the same nominal frequency for reception by a single receiver.

Yet a further problem associated with radio-linked systems is that it may be difficult or impossible to economically produce transmitters whose output frequencies are precisely the same and stable enough through long periods of time to assure reception by a radio receiver portion of a central alarm control device whose reception bandwidth is narrow enough to reduce background radio frequency noise in order to provide an adequate signal/noise ratio for reliable reception.

What is needed, then, is a radio-linked security alarm system which is low in cost, provides an extended period of operability without maintenance, whose transmitters are small enough for convenient installation, in which frequent reassurance of the operability of each transmitter is provided, and wherein positive identification of the location of an intrusion is provided automatically by the transmitter unit.

SUMMARY OF THE INVENTION

The aforementioned disadvantages of previously known wireless alarm systems are overcome by the present invention, which provides a low cost wireless alarm system and a method for communicating a dependable supervised one-way flow of information from remote sensors using a single transmission pathway to provide frequent, individually identifiable indications of the status of each of a plurality of sensor devices, as well as the status of the transmitter associated with each sensor device. The invention provides transmitters which are of small size, require a very small average current, and are operable for long periods of time without the necessity for maintenance. The wireless alarm system of the invention incorporates a supervisory technique and apparatus by which it becomes apparent within a predetermined time when one or more of the transmitters requires maintenance, and by which the identity of a particular transmitter unit requiring maintenance is made known.

A receiver-decoder and a plurality of encoder-equipped transmitter units are presettable to establish digitally encoded system and channel addresses, and a receiver-decoder of that system rejects signals from transmitters of similar systems operating nearby enough for reception by the receiver-decoder. The decoder section of the receiver-decoder accepts those messages received by the receiver portion only if the messages contain the correct digitally encoded system address, rejecting all other messages. Each message accepted by the decoder is checked for validity and only if valid is the message routed according to its digitally encoded channel address to a corresponding channel within the receiver-decoder. Preferably each channel address code is assigned to only one transmitter unit, and each message acceptable to the receiver-decoder is thus identifiable by its channel address code as having originated from that particular transmitter unit and its associated sensor.

Each message includes, in addition to the system and channel address codes, an indication of the output of the sensor associated with the particular transmitter which has sent the message, for example a door-operated switch which indicates whether a door is open or closed, a fire or smoke detector, or a manually operable portable switch for medical alert purposes. The particular channel receives, decodes, and provides an indication of the digitally encoded status data relating to the condition detected by the particular sensor.

Receipt of a valid message, regardless of the sensor data included in the message, resets a timer which relates to that particular channel in a maintenance warning portion of the receiver-decoder. Failure to receive a message allows a preset time to elapse, after which a maintenance requirement warning indication is provided. In this manner periodic transmission from each transmitter gives frequent reassurance of the operability of each individual transmitter.

In order to avoid interference between the several transmitters in each security alarm system, as well as avoiding interference between similar systems, all of which operate on a single transmission frequency channel, a very low duty cycle ratio is used. At predetermined periods each transmitter broadcasts a very brief message which includes system address, channel address, and sensor data, all in coded form. In a preferred embodiment of the invention each coded message includes address and sensor data sent twice in succession, the duplication permitting the decoder portion of the system to validate the message received.

The duty cycle ratio of each individual transmitter is so low, and the inter-transmission period is sufficiently different among the individual transmitters, that it effectively precludes statistically significant mutual interference among the transmitters of such a system. The length of each individual message, moreover, is short enough so that the individual transmitters each transmit a report frequently enough to be substantially equivalent to fully continuous "supervision" of the individual transmitters.

The low duty cycle also extends the life of the batteries of the transmitter units, and thereby extends the time during which the system will operate without maintenance, as well as reducing the size of the batteries required, and thereby reducing the overall size of each transmitter unit.

FM radio communication is used in the alarm system of the present invention in order to obtain a high signal/noise ratio, while reducing transmitter and receiver complexity. An added feature protects the communication link against frequency drift which may afflict components which operate over a long period of time.

It is therefore a principal objective of the present invention to provide an improved safety and security alarm system using miniaturized battery operated transmitters capable of long-term maintenance-free operation.

It is another important objective of the present invention to provide a wireless safety and security alarm system which is resistant to noise.

It is a further objective of the present invention to provide a wireless alarm system which provides a positive indication when system maintenance is needed, with identification of which of a plurality of individual transmitters requires maintenance.

It is yet a further objective of the present invention to provide a wireless alarm system which operates on a single nominal radio frequency and provides an indication of which individual transmitter has initiated an alarm indication.

It is a principal feature of the present invention that it provides a combination of frequency modulated radio transmitters utilizing a wide frequency shift to communicate digitally encoded information, with a frequency-tracking receiver-decoder for receiving and decoding the information.

It is another important feature of the present invention that it provides a transmitter which periodically transmits a formatted message in a brief amount of time followed by a relatively very long period of silence.

It is yet a further feature of the present invention that it provides a wireless alarm system which produces a warning when maintenance is required, along with an indication of where maintenance is required.

It is an important advantage of the present invention that it provides a more dependable radio-linked security alarm system than has previously been available.

It is another advantage of the present invention that it provides a transmitter for a wireless alarm system which uses a smaller average power and is thereby capable of operating through a longer lifetime using a given battery size than previously known transmitters of comparable size and capability.

The foregoing and other objectives, features and advantages of the present invention will be more readily understood upon consideration of the following detailed description of the invention taken in conjunction with the accompanying drawings.

BRIEF DESCRIPTION OF THE DRAWINGS

FIG. 3A is a schematic diagram of a manual switch interface circuit for use with the circuit of FIG. 3.

FIG. 3B is a schematic diagram of a loop switch interface circuit for use with the circuit of FIG. 3.

FIG. 4 is a graphic representation of an exemplary message transmitted by the transmitter shown in FIG. 3.

DETAILED DESCRIPTION OF THE INVENTION

Figure 1:
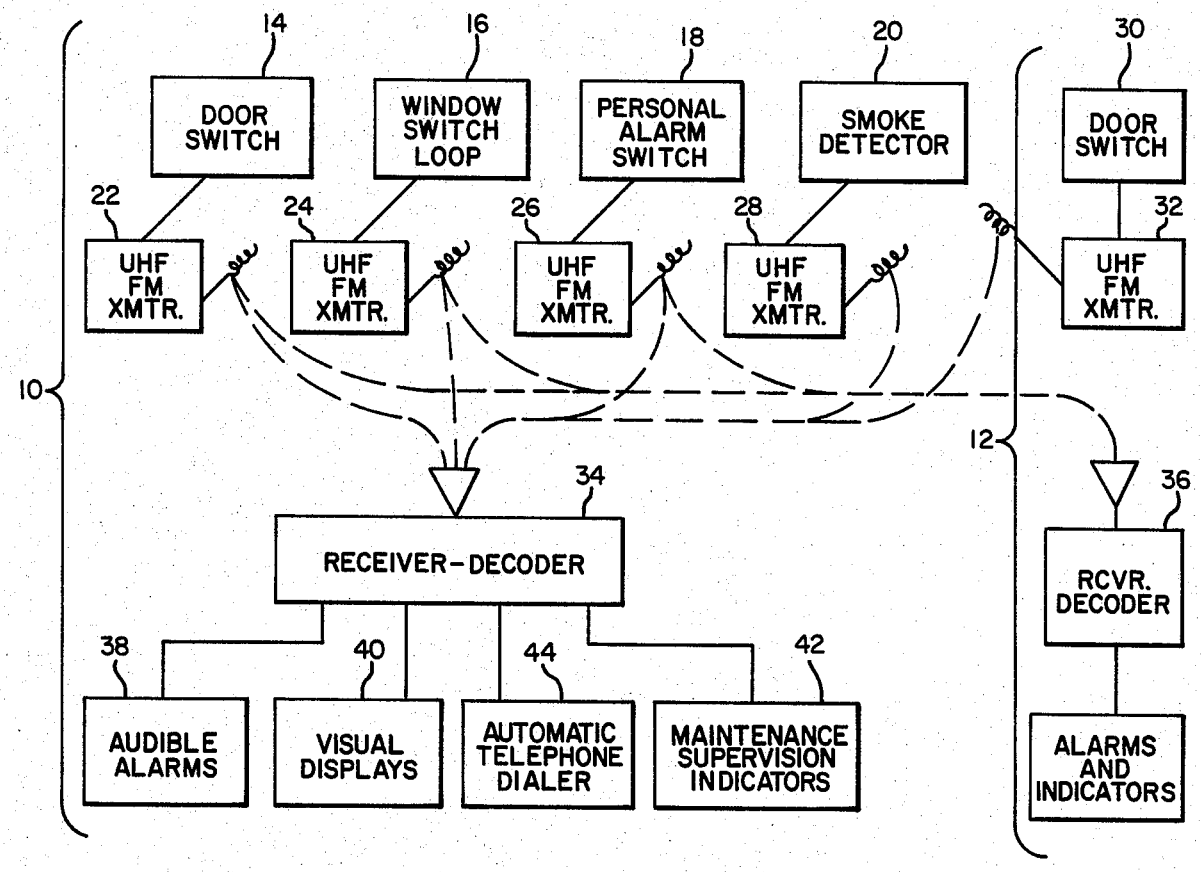
FIG. 1 is a block diagram of an alarm system embodying the present invention.

Referring now to the drawings, FIG. 1 shows security alarm systems 10 and 12, which embody the present invention, in block diagram form. Sensors, such as a door switch 14, a window switch loop circuit 16, a personal portable switch 18, and a fire sensor 20 are associated respectively with transmitters 22–28. Similarly, the door switch 30 is associated with a transmitter 32 in the alarm system 12. The alarm systems 10 and 12 include respective receiver-decoders 34 and 36, each of which includes indicators such as the audible alarm 38, the visual alarm display 40, and the maintenance warning indicators 42. An automatic telephone dialer 44 may also be connected to the receiver-decoder 34.

Transmitter

In accordance with the present invention each of the transmitters 22–28 and 32 are of identical construction and transmit on the same nominal transmitter frequency. Similarly the receiver-decoders 34 and 36 are tuned to receive transmissions in that same frequency band.

Figure 2:
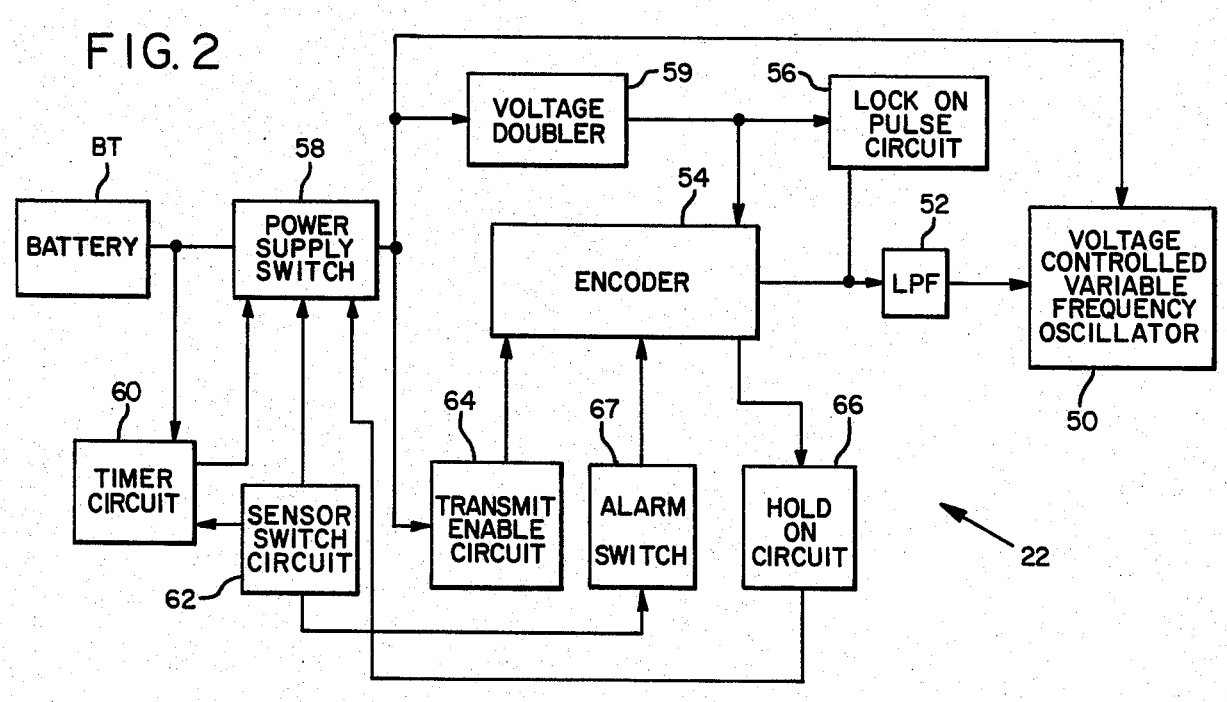
FIG. 2 is a block diagram of an exemplary transmitter-encoder unit which is included in the alarm system shown in FIG. 1.

Referring now also to FIG. 2, the transmitter 22 may be seen to comprise a voltage controlled variable frequency oscillator 50. An encoder 54, which may be an integrated circuit, and a lock-on pulse generator circuit 56 provide controlling voltages to the voltage controlled variable frequency oscillator 50 by way of a low-pass filter (LPF) 52. A power supply such as a battery BT provides power through a power supply switch circuit 58 to the variable frequency oscillator 50, and through a voltage doubler 59 to another part of encoder 54 and to a lock-on pulse circuit 56 to initiate transmission of a message each time an appropriate signal is provided to the power supply switch circuit 58 by either a timer circuit 60 or a sensor switch circuit 62. The signal from the power supply switch circuit 58 is also provided to a transmit enable circuit 64 which signals the encoder 54 to initiate transmission of a message. The encoder 54, in response, provides an information-carrying sequence of voltage pulses to the voltage controlled variable frequency oscillator 50, by way of the low-pass filter 52, and, for the duration of each transmission, provides a signal, through a hold-on circuit 66, to the power supply switch circuit 58, retaining the power supply switch circuit 58 in its "on" condition. An alarm switch 67 responds to the state of the sensor switch circuit 62, providing an input voltage enabling the encoder 54 to generate a data character reporting the status of the sensor switch as a part of each transmitted message.

Figure 3:
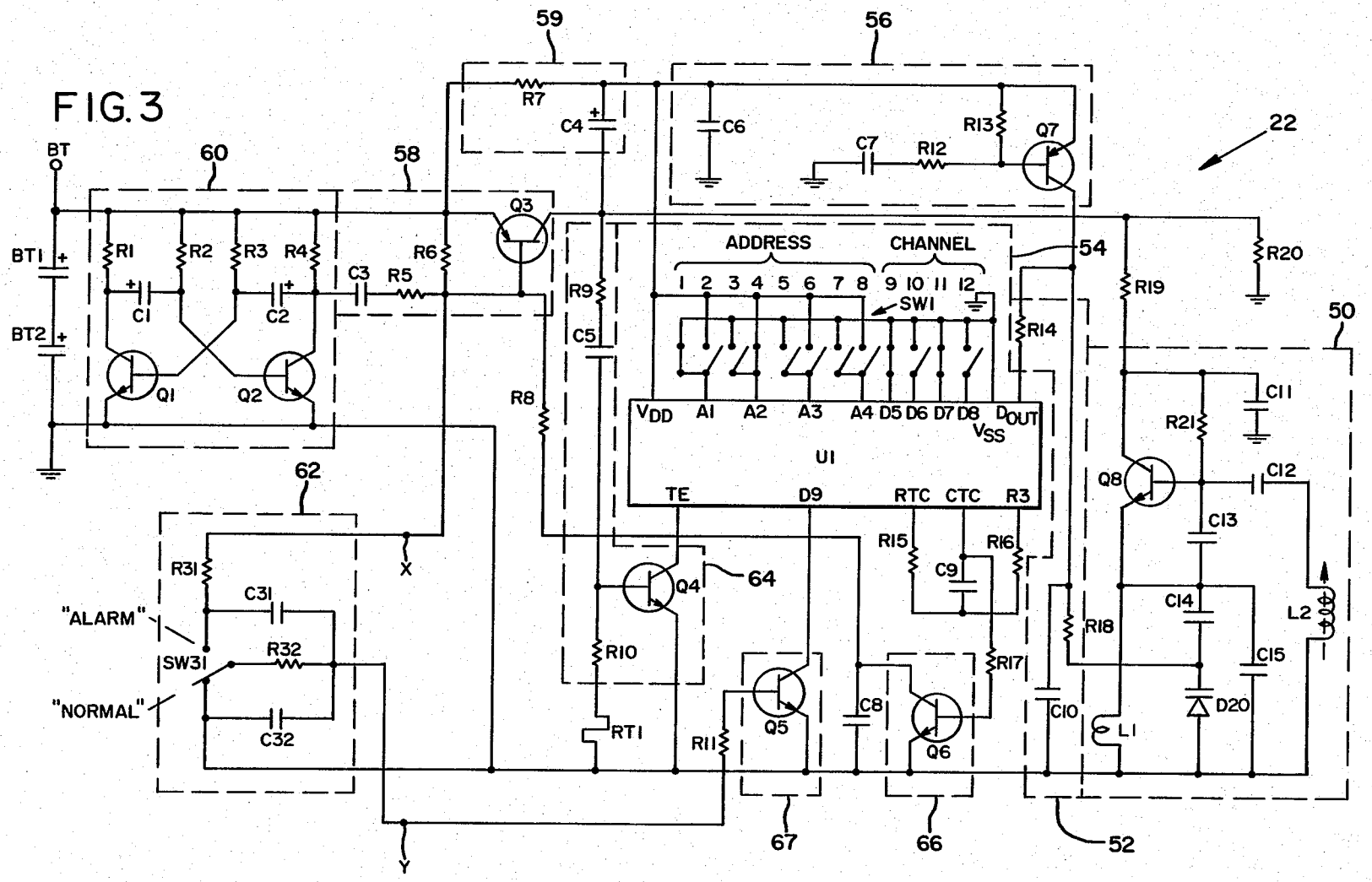
FIG. 3 is a schematic diagram of the circuit of the transmitter shown in FIG. 2.

An exemplary schematic diagram for the transmitter 22 may be seen in FIG. 3, showing a preferred embodiment of the transmitter 22. A battery power supply BT1, BT2 comprises a pair of "AAA" 1.5-volt alkaline cells connected in series, at least theoretically capable of powering the transmitter 22 for as long as several years. The timer circuit 60 is a multi-vibrator circuit including transistors Q1, Q2, which provides an enabling pulse to the turn-on switch circuit 58 through capacitor C3 and resistor R5, at intervals of approximately 35 seconds. This pulse provides a voltage across resistor R6, turning on transistor Q3 in the turn-on switch circuit 58.

When transistor Q3 turns on, the voltage at its collector rises to the voltage of the battery. The collector voltage of transistor Q3 is supplied across the transmit enable circuit 64 with current through the resistors R9 and R10 turning on transistor Q4 and presenting a ground potential or low voltage signal at a transmission enabling terminal TE of integrated circuit U1 of encoder circuit 54, during the time required to charge the capacitor C5.

The encoder 54 comprises an integrated circuit U1, for example integrated circuit MC145026PD manufactured by Motorola Semiconductor Products, Inc., and switch SW1, for example a double in-line package switch having twelve single pole, single throw (SPST) switches, which may be preset to control the output of the encoder. Each set of poles of the switch SW1 associated with a respective terminal $A_1$–$A_4$ has a possibility of three different settings, providing a total of 81 separate trinary encoded combinations, known as address codes. An address code serves to identify a particular alarm system. The SW1 poles associated with terminals $D_5$–$D_8$ may each be set in an open or closed position to provide sixteen separate binary combinations known as channel codes. A separate channel code is assigned to each transmitter in a particular alarm system.

The integrated circuit U1 is an encoder which will produce a nine-cell data word in serial format. When the enable terminal TE is pulsed, U1 provides two successive, identical data words out of terminal $D_{out}$. The cells of each data word correspond to the input terminals $A_1$–$A_4$ and $D_5$–$D_9$ according to the following relationship, beginning with the first cell Data word=A1A2A3A4D5D6D7D8D9

Each cell contains one digital character selected from the set characterized as containing the characters "open," "one," and "zero." The character is selected by the state of the device connected to the corresponding input terminal. As an example, terminals $A_1$–$A_4$, as shown in FIG. 3, are set, respectively, to produce characters zero, one, open, and open. Terminals $D_5$–$D_8$, as shown, are set, respectively, to produce characters zero, open, zero, and open.

The transmit enable terminal TE in the encoder integrated circuit U1 accepts pulses from the transmission-enabling circuit 64. Input terminal D9 accepts information from the sensor switch circuit 62 to provide a character for the 9th cell in each data word of the message format of the encoder 54. Terminals $R_{tc}$, $C_{tc}$, and $R_s$ are interconnected by a network including resistor R15, capacitor C9, and resistor R16 to set the frequency of an internal clock of the integrated circuit U1, which is established as 75 Kilohertz in the embodiment shown.

Terminal $D_{out}$ of the integrated circuit U1 produces, in a serial stream, the two-word output assembled according to the format described above, in voltage pulse, digital signal form. This output is provided through R14 to the low pass filter network 52.

The voltage doubler circuit 59 includes a high potential side having a resistor R7 connected between the positive terminal of the power supply and the side of capacitor C4 opposite the collector of transmistor Q3. The size of capacitor C4 is chosen to maintain the voltage across capacitor C4 nearly constant for the duration of each transmission. The combination of transistor Q3, resistor R7 and capacitor C4 thus provides approximately six volts between terminals Vdd and Vss of integrated circuit U1.

Included in the lock-on pulse generator circuit 56 is a transistor Q7 whose base is connected to ground through a resistor R12 in series with a capacitor C7. A resistor R13 is connected between the base of transistor Q7 and its emitter, which is connected to the positive side of capacitor C4. The collector of transistor Q7 is connected, through resistor R18, to the low-pass filter network 52.

The sensor switch circuit 62 includes switch SW31, which provides an electrical response to an actual sensed condition, such as whether a door is open. The condition of switch SW31 is communicated to the alarm bit switch 67, which in this embodiment comprises a transistor Q5 connected to provide an appropriate electrical signal to terminal D9 of the encoder U1. Switch SW31 connects the base of the transsistor Q5 through resistor R11 alternatively to a ground potential through resistor R32, or power supply voltage, through resistors R6, R31, and R32. A capacitor C31 is charged when switch SW31 is in a normal, or "door closed" position, one side of capacitor C31 being connected to resistor R31 and the other side to a junction between resistors R32 and R11. Also connected to the junction between resistors R32 and R11 is one side of a capacitor C32, whose other side is connected to ground.

When switch SW31 moves from the "door-closed" to the "door-open" or "alarm" position capacitor C31 discharges through resistor R32 and capacitor C32 charges, drawing current through resistors R6 and R31 and turning on transistor Q3. This lowers the voltage of the collector of transistor Q5, giving a low level input at terminal D9 of integrated circuit U1, thus encoding the alarm status detected by the sensor switch SW31. Conversely, when switch SW31 moves from the "door-open," or "alarm," position to the door-closed "normal" position, capacitor 32 discharges and capacitor C31 charges again, imposing a voltage across resistors R6 and R31 and turning transistor Q3 on.

In each case, when transistor Q3 is turned on, the voltage on capacitor C4 and at terminal $V_{dd}$ of integrated circuit U1, rises to approximately six volts. The current through transistor Q3 charges C5, turning on transistor Q4, and a transmission-enabling low pulse is provided from the transmission-enabling circuit 64 to the terminal TE of integrated circuit U1, activating the encoder circuit 54. Once the encoder circuit 54 is activated it proceeds through its programmed routine, and then shuts down. During this time the hold-on circuit 66 keeps transistor Q3 turned on to provide power to the encoder circuit 54 and the variable frequency oscillator 50. The hold-on circuit 66 includes transistor Q6, whose base is connected through resistor R17 to terminal $C_{tc}$ of integrated circuit U1, and whose collector is connected through resistor R8 to the base of transistor Q3 of the power supply switch circuit 58. Transistor Q6 is turned on by the voltage across R17 with each positive excursion of the internal clock output terminal $C_{tc}$ of U1. This action discharges C8, thus supplying a substantially constant current through R8 to the base of Q3 for the period of time utilized by U1 to generate its two-word output message, after which the internal clock is disabled.

Variable frequency voltage controlled oscillator circuit 50 comprises, preferably, a series tuned Colpitts type radio frequency oscillator, chosen because of its simplicity and stability. The instantaneous actual oscillator frequency is determined by the complex reactance of the network comprising RF coil L1, capacitors C13, C14, C15, and the junction capacitance of diode D20. This frequency is modulated by application of control voltage pulses from the collector of transistor Q7 and from the $D_{out}$ terminal of integrated circuit U1, through the low-pass filter 52, to the voltage-controlled variable capacitance diode D20 whose junction capacitance changes with changes in its junction voltage. This change in capacitance in turn modulates the reactance, and, thus, the frequency of oscillation of the oscillator 50. The nominal center frequency of the preferred embodiment is 314 MHz, which may vary slightly with variations in element characteristics; the frequency deviation of the transmitter of the preferred embodiment is ±2.5 MHz.

The voltage-controlled diode D20 is connected to ground and in series with the low-pass filter 52. The low-pass filter includes a resistor R18 whose high voltage side is connected to the collector of transistor Q7 of the lock-on pulse generator circuit 56 and, through resistor R14, to the terminal $D_{out}$ of the integrated circuit U1. A capacitor C10 is also connected, in parallel with the resistor R18 and diode D20, between Q7 and ground. The capacitor C14 has one side connected to a point between resistor R18 and diode D20, while its other side is connected to the emmitter of transsistor Q8 of the oscillator 50. The effect of the low-pass filter 52 is to slow the rise and fall times of the output voltage of the $D_{out}$ terminal of the encoder U1 to about 2 microseconds each, a rate producing a frequency change in the oscillator's output which can be tracked by a receiver including a suitable automatic frequency tracking circuit.

As a result of the voltage doubling effect of the combination of transistor Q3 and capacitor C4, when transistor Q3 is turned on, the voltage across diode D20 jumps to six volts through the action of transistor Q7, and the D1 capacitance is reduced, raising the output frequency of the oscillator circuit 50 to its maximum, where it remains for approximately 10 microseconds. As capacitor C7 in the lock-on pulse generator circuit 56 is charged it begins to turn transistor Q7 off which causes the voltage across diode D20 to decrease. Under the influence of the decreasing voltage across D20, the instantaneous frequency of the variable frequency voltage-controlled oscillator 50 decreases, over about 5 microseconds, to its minimum. The time during which this occurs is referred to as the "lock-on" period.

In the preferred embodiment, the RF output of the voltage-controlled oscillator circuit 50 is allowed to radiate from the circuit elements, unaided by an antenna. This helps reduce the size of the transmitter 22. It is understood, however, that an antenna may be employed with the transmitter 22 to radiate the RF output.

The timing of the outputs of integrated circuit U1 and the lock-on circuit 56 with reference to the action of oscillator 50 is shown in FIG. 4, which illustrates the frequency output of oscillator 50 with time. When Q3 is activated by the timing circuit 60, oscillator 50 turns on and lock-on circuit 56 provides the "lock-on" pulse through diode D1 in the manner described above which causes the frequency of the oscillator 50 to vary accordingly. At the same time that the lock-on pulse begins, the TE terminal of the integrated circuit U1 is pulsed by transmit enable circuit 64. In the Motorola M145026PD, which comprises U1 in the preferred embodiment, a preliminary period, equivalent in time to two data characters, passes before the first data word is output from terminal $D_{out}$ of U1. The Motorola device then provides as an output from terminal $D_{out}$ two successive, identical data words, with a three-character time space separating the pair. As this output, which swings between ground and the voltage at terminal $V_{dd}$, is provided through the diode D20 to the oscillator 50, the effect on the frequency oscillator 50 output is clearly shown in FIG. 4. After the second word is output, integrated circuit U1 automatically shuts off itself and, through hold-on circuit 66, the rest of the transmitter 22 as described hereinabove.

Alternative embodiments of the transmitter circuit illustrated in FIG. 3 are provided by use of the switch circuits shown in FIGS. 3A and 3B.

FIG. 3A depicts a switch circuit which can be substituted for the sensor switch circuit 62 of the FIG. 3 circuit by connecting each circuit point X, Y, BT and ground to its identically designated corresponding point in the FIG. 3 circuit. A switch, SW61, which can comprise, for example, a push-button mechanism in a hand-held transmitter serving as a personal emergency alarm, is depressed, which discharges capacitor C61 through R63. This turns on transistor Q61, activating a timing circuit which includes transistors Q62 and Q63. The values of the timing circuit elements are selected to cause the circuit to oscillate with a period considerably less than the period of timer circuit 60. In the embodiment shown, the values of resistors R65–68 and capacitors C62 and C63 are selected to cause Q3 and the rest of transmitter 22, through circuit connection X, to be switched on every 0.16 seconds. This oscillation will be maintained until switch SW61 is opened, and after that, for the period of time, determined by the values of R61, R62, and C61, required to charge up C61. While switch SW61 is closed, and thereafter for the period of time required to charge C61, the collector voltage of transistor Q61, through circuit connection Y, activates the alarm bit switch 67 and causes the alarm status encoded at terminal D9 of integrated circuit U1 to be set. Thus, closing switch SW61 will increase the rate of transmission and cause each transmission occurrance in the speeded-up sequence to carry an alarm indication.

FIG. 3B depicts a circuit for sensing the state of a switch series loop L40 connected between terminals $T_{41}$ and $T_{42}$. The switch loop L40 can comprise, for example, a circuit connecting in series the window and door sensor switches in a single room or group of rooms. The circuit of FIG. 3B is connected at points X, Y, BT, and ground, respectively, to the identically-designated points in the circuit shown in FIG. 3. When any of the switches in loop L40 opens, the loop opens and capacitor C41 is charged toward the potential of BT through resistor R41. The current through R41 turns transistor Q41 on. When Q41 turns on, its collector goes to ground which turns off the transistor pair Q42 and Q44, which have kept point Y at ground and Q5, the alarm bit switch of FIG. 3, off. When transistor Q41 turns on, transistor Q43 turns on quickly through resistor R47 and capacitor C42 because the value R42 is several orders of magnitude less than that of resistor R46. After C42 is charged, base current for Q43 is supplied through R46. The speed of Q43's switch into operation causes circuit point Y to be quickly driven positive. This quick excursion is fed back to transistor Q41 through resistor R53, which speeds up the operation of Q41. The shift into operation of transistor Q43 causes capacitor C44 to discharge and capacitor C45 to charge, which causes current to flow through circuit point X, creating a voltage drop across resistor R6 of FIG. 3. The R6 voltage drop activates transistor Q3 and, with it, transmitter 22. At the same time, circuit point Y is driven positive which causes the alarm bit switch transistor Q5 to turn on, providing an alarm indication to integrated circuit U1. Thus, whenever a switch is opened in the switch loop L40, the switch circuit of FIG. 3B turns on the transmitter 22 and causes it to transmit an alarm indication. The alarm indication will remain set because transistor Q5 of the transmitter 22 will remain on through the operation of transistors Q41 and Q43 of the FIG. 3B circuit. When all switches in the loop L40 are closed and the loop is conductive again, capacitor C41 will discharge to ground potential, turning off transistor Q41, which will cause its collector voltage to rise to BT; this, in turn, will activate Q42 and turn Q43 off. Current through Q42 will cause a voltage drop across resistor R50, which will turn Q44 on. When Q44 goes on, capacitor C45 will discharge, C44 will charge, and the charging current will activate Q3 of the transmitter 22, causing the transmitter once more to transmit. This time, with Q44 on and circuit point Y at ground, Q5 of the transmitter will be turned off, leading terminal D9 of transmitter integrated circuit U1 to sense an open, which will cause the transmitter to indicate a clear or no-alarm condition. The transmitter 22 will then resume its normal non-alarm operation under control of timer circuit 60.

Table I shows the values and types of components of the exemplary transmitter 22 shown in FIG. 3 and switch circuits shown in FIGS. 3A and 3B.

TABLE I

| CIRCUIT ELEMENT REFERENCE NUMERAL FROM FIGS. 1-3.B | TYPE, DESIGNATOR, OR VALUE OF COMPONENT |
|---|---|
| R1,13,41,65,68 | 1.0 Megohm |
| R2,3,50,66,67 | 10 Megohms |
| R4,11,45,46,49,53 | 2.2 Megohms |
| R5,69 | 3.3 Kilohms |
| R6,18,20 | 33 Kilohms |
| R7,8,12,43,44 | 8.2 Kilohms |
| R9,42,47,48 | 100 Kilohms |
| R10 | 30 Kilohms |
| R14,31,51,52 | 5.1 Kilohms |
| R15 | 10 Kilohms |
| R16 | 20 Kilohms |
| R17 | 220 Kilohms |
| R19 | 100 ohms |
| R21 | 15 Kilohms |
| R32 | 10 ohms |
| R61,62,64 | 270 Kilohms |
| R63 | 10 ohms |
| C1,2,61 | 2.2 microfarads, tantulum |
| C3,6,8,41,42,43,44,45,62,63,64 | 0.01 microfarads |
| C4 | 10 microfarads, tantulum |
| C5 | 2,200 picofarads |
| C7,11 | 390 picofarads |
| C9 | 560 picofarads |
| C10 | 120 picofarads |
| C12 | 10 picofarads |
| C13 | 33 picofarads |
| C14,15 | 8.2 picofarads |
| D1 | MV310 voltage-controlled diode |
| L1 | 0.47 microHenry coil |
| L2 | tunable coil |
| U1 | MC145026PD, Motorola integrated circuit |
| Q1,2,4,5,6,41,42,44,62,63 | 2N5089 |
| Q3,7,43,61 | 2N4403 |
| Q8 | MPS-H10 |
| RT1 | 1,500-ohm NTC thermistor |
| SW1 | 12-pole ST switch |
| SW31 | Form C magnetic reed switch |
| SW61 | SPST push-button switch |
| T41,42 | Screw terminal |

Receiver-Decoder

Figure 5:
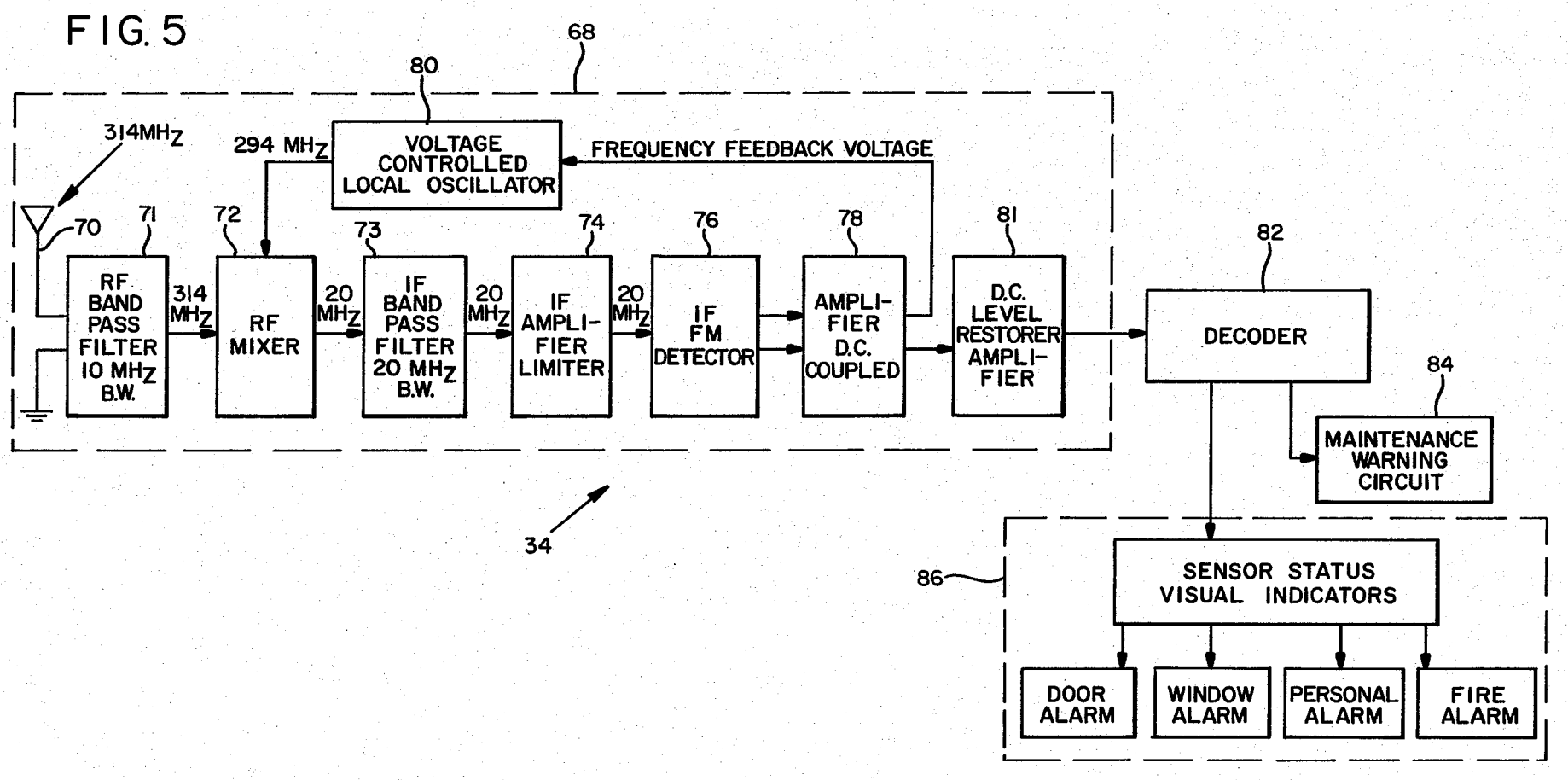
FIG. 5 is a block diagram of an exemploary receiver-decoder of the alarm system shown in FIG. 1.
Figure 6:
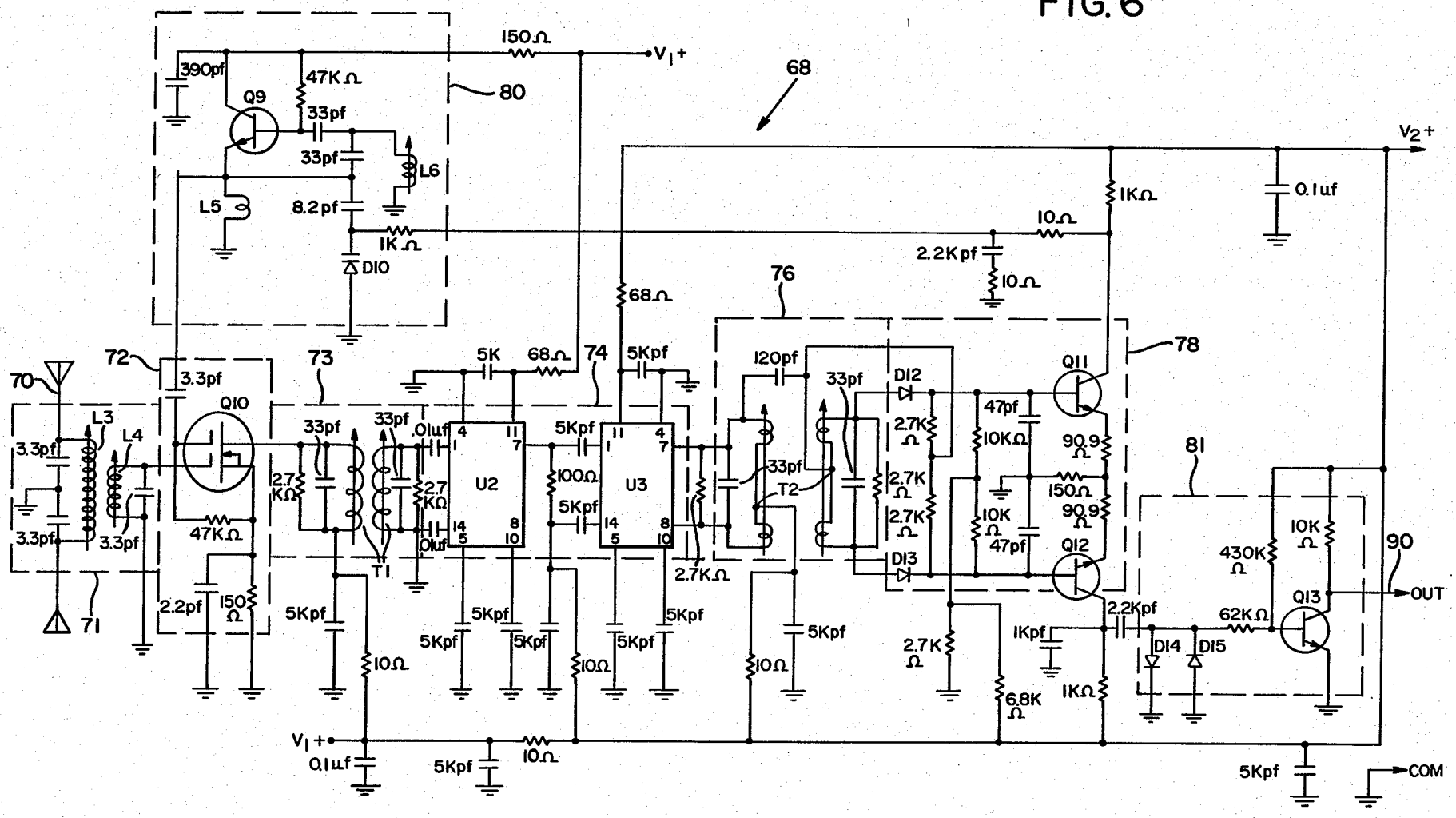
FIG. 6 is a schematic circuit diagram of the receiver portion of the receiver-decoder shown in FIG. 5.
Figure 7:
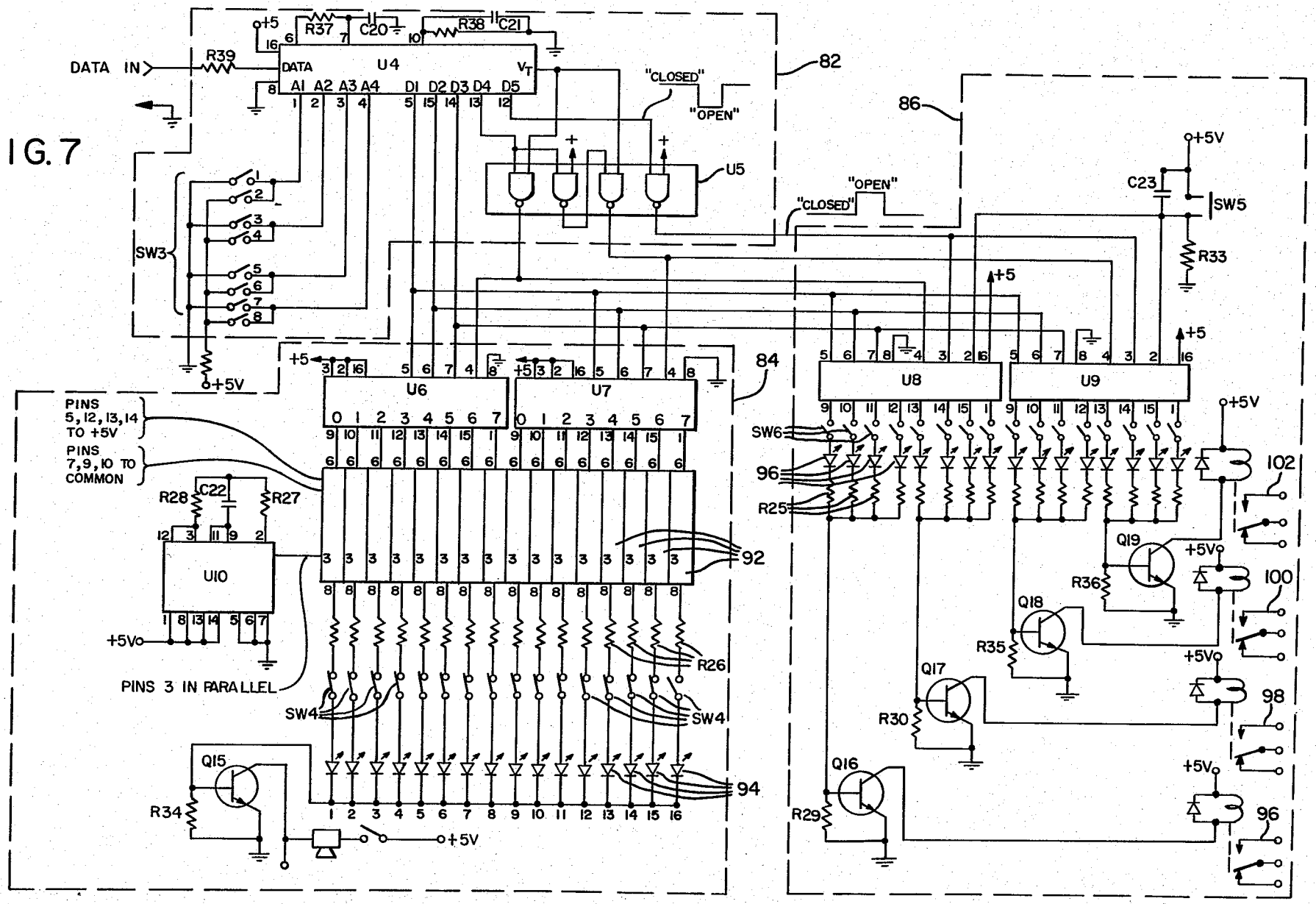
FIG. 7 is a schematic circuit diagram of the decoder portion of the receiver-decoder shown in FIG. 5.

The receiver-decoder 34 is shown in block diagram form in FIG. 5 and schematically in FIGS. 6 and 7. The receiver 68 portion may be seen to comprise a receiver antenna 70, a 10 MHz bandwidth band-pass filter 71 tuned to a 314 MHz center frequency, a wide-band radio frequency (RF) mixer 72, a narrow-band intermediate frequency (IF) band-pass filter 73 with a 2 MHz bandwidth, an IF amplifier 74, and an IF FM detector circuit 76. A frequency signal, representing the difference between the voltage-controlled oscillator frequency and the received signal frequency, is passed through the IF band pass filter 73 from the wide-band RF mixer 72 for amplification in the narrow-band IF amplifier 74. A frequency feedback output voltage from the FM detector circuit 76, a voltage which is higher with a higher received signal frequency and lower with a lower received signal frequency, is provided through a dc-coupled amplifier 78 to modulate the output frequency of a voltage-controlled variable frequency local oscillator 80.

The frequency feedback voltage, corresponding to any change in the frequency of the RF signal, thus controls the difference frequency output by the RF mixer 72, allowing the receiver 68 to follow the RF signal of the transmitter 22 even though its frequency varies over a range greater than the IF section bandwidth. The amplified signal detected in the detector 76 is also provided to the decoder 82 by way of a dc level restorer amplifier 81.

As explained previously, the frequency variations transmitted by the transmitter 22 amount to serially encoded digital data characters forming a message consisting of two 9-cell words. When this message is provided by the amplifier 78 to the decoder 82, the decoder circuit reads and remembers the first word, compares the second word to the first word, and if the two words are identical converts the last five characters of data in the word, corresponding to the states of terminals D5–9 of the transmitter encoder integrated circuit U1, from serial to parallel form. The fifth through eighth characters of data in each word provide a channel address in binary coded form, allowing a choice of sixteen separate channel addresses. The final character of each word is the sensor status data character which indicates whether the switch SW1 is in the "normal" or "alarm" position.

For each transmission received whose system address matches the system address of the decoder 82, indicating that that the transmission received is from a transmitter belonging to the system 10 to which the receiver decoder 34 belongs, a signal is provided to the proper one of the sixteen parallel channels of both a matinenance warning circuit 84 and an alarm indicator circuit 86. Receipt of such a signal in any particular channel resets a timer circuit in the respective channel of the maintenance warning circuit 84, preventing a matinenance warning from being produced by the receiver-decoder 34.

FIG. 6 shows schematically a receiver circuit 88 which is tunable to a nominal radio frequency of 314 Megahertz, compatible with the transmitter circuit 22 shown in FIG. 3. It will be seen that the RF signal received through the antenna 70 is filtered and mixed with a signal produced in the local voltage-controlled variable frequency oscillator 80, the difference between the two frequencies being passed through a tuned band-pass coupling transformer filter 73 into the intermediate frequency amplifier 74 comprising a pair of integrated circuits U2, U3 and thence into the detector 76. The band-pass filter 73 is tuned to 20 MHz, with a bandwidth of 2 MHz, allowing only RF signals whose frequency is very close to the actual instantaneous frequency of the transmitter 22 to be amplified and detected. An output signal from the IF detector 76, a 20 MHz Foster-Seeley type FM discriminator, is amplified and provided as a feedback to modulate the frequency of the local oscillator 80. The signal is also amplified in the dc level restorer amplifier 78 and provided at the data output terminal 90. The dc level restorer centers the amplified output of the detector on the input transfer characteristic of transistor Q13 which acts as a slicing amplifier to provide a voltage pulse digital signal which can be handled by the decoder 82.

Table II lists exemplary components of the receiver circuit 68 of FIG. 6.

TABLE II

| CIRCUIT ELEMENT REFERENCE NUMERAL FROM FIG. 6 | TYPE, DESIGNATOR, OR VALUE OF COMPONENT |
|---|---|
| Q9 | MPS-H10 Transistor |
| Q10 | 3N209 Transistor |
| Q11–Q13 | 2N5089 Transistors |
| L3 | Antenna loading coil |
| L4 | RF tuned coil |
| L5 | 0.47 Microhenry choke |
| L6 | Oscillator tuned coil |
| U2, U3 | MC1355 integrated circuit |
| D10 | MV310 Variable capacitance diode |
| D12, D13 | MBD102 Hot carrier diode |
| D14, D15 | IN916B Diode |
| T1 | 20 MHz IF transformer |
| T2 | 20 MHz Discriminator transformer |

The data provided by the receiver 68 as its output is processed in the decoder 82 to determine whether the signal received is relevant to the alarm system 23, whether it contains a valid message, and to determine what sensor status has been reported in the message. The decoder circuit 82, shown schematically in FIG. 7, includes an integrated circuit U4. The circuit U4 is a Motorola MC145027, modified by the manufacturer to provide four address terminals $A_1$–$A_4$ and five data terminals $D_5$–$D_9$ for the purposes disclosed herein. A presettable address encoding switch SW3 is connected to address data terminals $A_1$–$A_4$ of integrated circuit U4. Any received message which contains the proper combination of data characters matching the selected settings of the address encoding switch SW3 is processed by reading and storing the additional five characters of data in the first word. If the second word is identical to the first word received, the integrated circuit U4 passes on the combination of characters from its data output terminals $D_1$–$D_4$ to provide the identification of the particular channel, within the alarm system 12, whose transmitter has sent a message. This channel identification information is transmitted through a gate circuit U5 to two pairs of integrated circuits, included respectively in the maintenance warning circuit 84 and the alarm indicator circuit 86. Each time a valid message is received for a particular channel the integrated circuits U6 and U7 provide a resetting pulse to the appropriate one-shot timer circuit 92, of which one is provided for each channel. The timer circuits 92 count down at a frequency established by the integrated circuit U10. So long as a valid signal is received on each channel, resetting the associated circuit 92 within a predetermined time, the maintenance warning circuit 84 interprets the situation as being normal.

If, however, no signal is received on a particular channel within the time provided by the timer circuit 92, the respective timer circuit 92 switches on, providing power to the appropriate maintenance warning light emitting diode 94. This causes the respective diode 94 to light, indicating which of the sixteen channels is experiencing a malfunction, and also turns on transistor Q15 whose output is connected to provide an optional audible warning that maintenance is required in the system. A switch SW4 for each channel permits that channel's one-shot timer 92 to be disconnected from the associated LED 94 and from the transistor Q15.

The four channel-identifying data characters are also provided to the pair of integrated circuits U8 and U9, which similarly read the combination of characters provided from terminals D1–D4 of the integrated circuit U4 and provide an output to the appropriate channel's alarm circuit. Also provided to each of the integrated circuits U8 and U9 is the final character of each nine-cell word received, providing an indication of the sensor status reported. So long as the sensor status is normal, corresponding to a "normal" position of switch SW1 in the particular transmitter 22 which has sent the message received and decoded, no output will be provided to any of the channels from the integrated circuits U8 and U9.

When the message transmitted includes an "alarm" status as the final data character, the output on that particular channel goes high and latches there until reset by a "normal" message or by a manual indicator reset switch SW6. The channel outputs of U8 and U9 can also be reset by a manual alarm reset switch SW5 connected with terminals of U8 and U9. The high output on an output channel of U8 or U9 lights an associated light emitting diode 96 and turns on an associated transistor Q16, Q17, Q18, or Q19, whose collector current then actuates an appropriate one of the relays 98, 100, 102, or 104 to initiate a predetermined course of action, such as actuating an automatic telephone dialer 44 or an audible fire or burglar alarm 38.

Table III lists exemplary components of the decoder of FIG. 7.

TABLE III

| CIRCUIT ELEMENT REFERENCE NUMERAL FROM FIG. 6 | TYPE, DESIGNATOR, OR VALUE OF COMPONENT |
|---|---|
| C20,21 | .0022 microfarad capacitor |
| C22 | .047 microfarad capacitor |
| C23 | 0.1 microfarad capacitor |
| U4 | Integrated circuit MC145027, Motorola (modified) |
| U5,10 | Integrated circuit MC14011B, Motorola |
| U6,7,8,9 | Integrated circuit MC14099B, Motorola |
| Q15–Q19 | 2N4401 |
| 92 | MC14541 binary counters (16) |
| R25 | 330 ohm resistors (16) |
| R26 | 680 ohm resistors (16) |
| R27,38 | 180 Kilohms |
| R28 | 68 Kilohms |
| R33,39 | 20 Kilohms |
| R29,30,34,35,36 | 2.7 Kilohms |
| R37 | 10.5 Kilohms |

System Operation

The use of four trinary encoded data characters for each system address code provides a choice of up to 81 systems such as the alarm systems 10 and 12, each containing 16 channels, which may be selected using the settings of contacts 9–12 of transmitter switch SW1 to provide channel identification in the message transmitted by each transmitter 22, with each transmitter 22 being capable of reporting a normal or alarm condition using the final data character of the nine-cell word automatically transmitted by the encoder U1. Including the two-cell initial space, the nine-cell word, the three-cell interword space, and the second nine-cell word, with each cell taking eight cycles of the internal clock of the integrated circuit U1, approximately 182 cycles of the internal clock are required for a complete transmission which is triggered each time the timer circuit 60, or a sensor switch circuit turns on the transistor Q3.

According to the preferred embodiment of the present invention, the internal clock frequency of the integrated circuit U1 determined by the combination of R15, C9, and R16 is preferably at least 75 KHz, and the entire message is transmitted in a period of approximately 0.0025 seconds or less. A transmission is followed by a non-transmitting period of approximately 35 seconds established by the timer circuit 60, giving an operating duty cycle ratio of no more than about one in 14,000 for any one transmitter. Because of the random difference between the transmission periods initiated by the timer circuits of different transmitters 22, the result is a very low likelihood of interference between any two transmitters 22 in any one system 10 or 12 even though all of the transmitters 22 are operating on the same nominal radio frequency, unless more than one transmitter 22 is assigned the same channel address code.

It is understood, however, that the duty cycle may be substantially higher than this figure and may be changed, for example, to as high as one in 100 by speeding up the timer circuit 60 and changing the internal clock rate of the integrated circuit U1.

While a duty cycle ratio as great as 1:1,000 would be usable with a small number of potentially interfering transmitters 22, a lower duty cycle is preferred. In the preferred embodiment, then, with 16 transmitters 22 in a system 10, all transmitting on the same nominal frequency, with an operating duty cycle ratio of about 1:14,000 for each transmitter, there is a statistical probability of approximately 1/438 that any single transmission may be blocked by a simultaneous or overlapping transmission from another of the 16 transmitters 22, and the statistical likelihood of two successive transmissions from any single transmitter being blocked is only about 1/192,000 or, converted into time by multiplying by the 35 second nominal period of the clock circuit 60, two successive blocked transmissions once in 77 days. Carried further, this equates to a false maintenance indication having only one chance in 45,000 of occurrence in a one-year period, or a probability of only 1 in 36,000,000,000 of four successive transmissions being blocked. While the statistical likelihood of such malfunctions would increase with increased use of the doors and other facilities with which sensors are associated, the statistical probabilities stated would be substantially correct during periods when a building equipped with the alarm system 10 is unoccupied and therefore most vulnerable.

Even when 27 alarm systems with 16 transmitters per system, totalling 432 transmitters, are operating in the same frequency band within receivable range of the receiver-decoder of a particular system, the statistical chance of a door being opened in that system without receipt of the first transmission of a "door open" message (because of an overlapping transmission by a transmitter in a neighboring system) is only one in sixteen, and the chance only 1/256 that the door could remain open for as long as 35 seconds, or two transmissions from the transmitter 22, without triggering the associated alarm and providing an identification of the open door.

As a final example, on a system having four transmitters, with each transmitter adjusted to provide a relatively high duty cycle of one in 100, as by scheduling a 0.1 second transmission every 10 seconds, there is only one chance in 12.5 that the first transmission of any one transmitter will be blocked, and one in 156 that the second scheduled transmission 10 seconds later would overlap the transmission of another transmitter.

The result is that the very low duty cycle ratio reduces to statistical insignificance the likelihood of failure to receive an alarm transmission within an acceptable time.

An attendant benefit of the low duty cycle ratio is an extension of transmitter battery lifetime which results from the reduction in transmission or "on" time.

While the antenna and radio frequency amplifier section of the receiver 34 are tuned to receive transmissions in the frequency band extending at least 1.6% of the nominal frequency on either side of the nominal frequency, the intermediate frequency amplifier is tuned to receive signals within a much narrower frequency bandwidth of only 2.0 Megahertz, less than 50% of the full 5 Megahertz frequency shift due to the ±2.5 MHz frequency deviation. For this reason, the lock-on pulse generated at the beginning of each transmission from each transmitter includes a sweep of the actual instantaneous oscillator frequency passing relatively slowly through the nominal frequency to which the receiver is tuned, to give the receiver an opportunity to detect the transmitted signal and begin tracking the variations of transmission frequency which contain the system address, channel address, and status data in frequency modulated digitally encoded format. The range of the initial frequency ramp provided by the transmitter extends from approximately 2.5 Megahertz (0.8%) above the inherent actual center frequency of the oscillator to 2.5 Megahertz (0.8%) below the inherent actual center frequency of the oscillator. Thus the frequency ramp ensures that the frequency of the transmission will pass through the tuned nominal frequency of the receiver, even though the transmitter oscillator's actual frequency may shift by as much as 0.8% as a result of temperature shifts, supply voltage variations, or changes of the characteristics of its electronic components during its lifetime.

The present invention teaches, then, avoiding interference among a plurality of transmitter units in a wireless security alarm system and avoiding interference among a plurality of similar systems, all operating in a single radio frequency channel, by periodically transmitting from each transmitter a message whose length is as short as practicable, but certainly less than 1/10 of a second, and thereafter waiting for a period of at least 10 seconds as required by government regulations. This method avoids interference between transmitters by the use of an extremely low duty cycle ratio while still transmitting frequently enough to provide assurance of transmitter operability, to reduce the likelihood of transmission by more than one transmitter in the reception area during the same time to a statistically insignificant value. Additionally, the invention comprises transmission of information using a digitally encoded frequency modulation keyed message format, receiving each transmission by the use of a receiver which has an intermediate frequency section whose bandwidth is narrower than the received signal frequency deviation, and which locks onto the tracks the changing frequency of the transmitted signal.

Furthermore, the present invention teaches a method of continually verifying that each transmitter of a wireless alarm system according to the invention remains operable, by providing a maintenance warning whenever the time since the last valid signal from any single transmitter unit of the system exceeds a predetermined value and by using digitally encoded system address and channel address information to identify specifically which transmitter has sent a particular message or has failed to send any message.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A security monitoring system, comprising:

(a) sensor means for detecting an observable event;

(b) a transmitter including means for responding to said sensor;

(c) a radio frequency oscillator included in said transmitter and having a nominal oscillation frequency and an actual oscillation frequency;

(d) modulator means associated with said oscillator for varying said actual instantaneous oscillation frequency;

(e) encoder means associated with said transmitter and responsive to said sensor for causing said modulator to vary said actual oscillation frequency by a predetermined frequency shift in accordance with a digital code pattern including a sensor status code;

(f) a receiver having a radio frequency band-pass filter tuned to said nominal frequency, said band-pass filter having a radio frequency bandwidth extending at least said predetermined frequency shift on each side of said nominal frequency;

(g) automatic frequency tracking circuit means for tuning said receiver to follow radio frequency signals produced by said transmitter while said modulator varies said transmitter actual oscillation frequency by said predetermined frequency shift in accordance with said digital code pattern;

(h) detector means included in said receiver and responsive to the changes of said actual oscillation frequency for detecting said digital code pattern and providing an electrical signal corresponding thereto;

(i) decoder means for receiving and decoding said electrical signal; and (j) wherein said transmitter includes lock-on pulse generator means connected controllingly to said modulator for sweeping said actual oscillation frequency through a range of frequencies including said nominal frequency during each transmission, at a lower rate of change of actual oscillation frequency than the rate at which said encoder means causes said modulator to vary said actual oscillation frequency, before said encoder means causes said modulator to vary said actual oscillation frequency.

2. A transmitter for use in a wireless security monitoring system, comprising;

(a) a radio frequency oscillator having an actual frequency within a predetermined frequency range of a first predetermined frequency;
(b) encoder means for producing a pulse train including digitally coded address and sensor data;
(c) modulator means interconnecting said encoder means and said radio frequency oscillator for modulating said actual frequency in response to said pulse train to produce a frequency-modulated output signal;
(d) multivibrator means connected to said encoder means for periodically initiating transmission of said output signal;
(e) sensor-responsive means connected to said encoder means for initiating transmission of said output signal in response to detection of a predetermined event by a sensor; and
(f) voltage ramp generating means connected to said modulator means for causing said actual frequency to sweep through said first predetermined frequency at a predetermined rate of change of frequency before said encoder means produces said pulse train.

3. A wireless security monitoring system, comprising:
(a) sensor means for detecting an observable event;
(b) a battery powered transmitter including means for responding to said sensor means;
(c) a radio frequency oscillator included in said transmitter and having a nominal oscillation frequency and an actual oscillation frequency;
(d) modulator means associated with said oscillator for varying said actual oscillation frequency;
(e) encoder means associated with said transmitter and responsive to said sensor means for causing said modulator to vary said actual oscillation frequency by a predetermined frequency shift in accordance with a digital code pattern including a sensor status code, wherein said predetermined frequency shift is at least as great as the maximum expected difference between said actual oscillation frequency and said nominal oscillation frequency;
(f) a receiver having a radio frequency band-pass filter tuned to said nominal frequency, said band-pass filter having a radio frequency bandwidth extending at least said predetermined frequency shift plus said maximum expected difference on each side of said nominal frequency;
(g) detector means included in said receiver and responsive to the changes of said actual oscillation frequency for detecting said digital code pattern and providing an electrical signal corresponding thereto;
(h) decoder means for receiving and decoding said electrical signal; and
(i) wherein said transmitter includes pulse generating means for producing at least one pulse varying from the actual oscillation frequency by a frequency at least as great as the maximum expected difference between the nominal oscillation frequency and the actual oscillation frequency, and said receiver means including lock-on means responsive to said pulse for locking said receiver to said actual oscillation frequency prior to the detection of said digital code pattern by said detector means.

4. The security monitoring system of claim 3 wherein said transmitter includes timing means for periodically enabling said transmitter to transmit a coded message and wherein the ratio of the time that said transmitter is enabled to the time that it is disabled lies in the range of 1:100 to 1:14,000.

5. The security monitoring system of claim 4 wherein said coded message comprises a channel address code identifying said transmitter and a sensor status code conveying data detected by said sensor means.

* * * * *

UNITED STATES PATENT AND TRADEMARK OFFICE

CERTIFICATE OF CORRECTION

PATENT NO. : 4,523,184

DATED : June 11, 1985

INVENTOR(S) : William Abel

It is certified that error appears in the above-identified patent and that said Letters Patent is hereby corrected as shown below:

In the Abstract, line 15:
Change "ir" to --is--

Column 4, line 51:
Change "exemploary" to --exemplary--

Column 6, line 48:
Change "transmistor" to --transistor--

Column 7, line 2:
Change "transsistor" to --transistor--

Column 8, lines 23 and 47:
Change "D1" to --D20--

Column 11, line 42:
Change "matinenance" to --maintenance--

UNITED STATES PATENT AND TRADEMARK OFFICE

CERTIFICATE OF CORRECTION

PATENT NO. : 4,523,184

DATED : June 11, 1985

INVENTOR(S) : William Abel

It is certified that error appears in the above-identified patent and that said Letters Patent is hereby corrected as shown below:

Column 11, line 46:
Change "matinenace" to --maintenance--.

Signed and Sealed this

Tenth Day of August, 1993

*Attest:*

Michael K. Kirk

MICHAEL K. KIRK

*Attesting Officer*

*Acting Commissioner of Patents and Trademarks*